US005817228A

United States Patent [19]

Greaney et al.

[11] Patent Number: 5,817,228

[45] Date of Patent: Oct. 6, 1998

[54] METHOD FOR ANODICALLY DEMETALLATING REFINERY FEEDSTREAMS

[75] Inventors: Mark Alan Greaney, Upper Black Eddy, Pa.; Michael Charles Kerby, Baton Rouge, La.

[73] Assignee: Exxon Research and Engineering Company, Florham Park, N.J.

[21] Appl. No.: 771,107

[22] Filed: Dec. 20, 1996

[51] Int. Cl.[6] ..... C10G 32/02

[52] U.S. Cl. ..... 208/251 R; 205/696; 205/702; 204/513

[58] Field of Search ..... 208/251 R; 205/696, 205/702; 204/513

[56] References Cited

U.S. PATENT DOCUMENTS

| | | | |
|---|---|---|---|
| 2,996,442 | 8/1961 | Eberly, Jr. et al. | 204/513 |
| 3,153,623 | 10/1964 | Eldib et al. | 204/513 |
| 3,457,152 | 7/1969 | Maloney et al. | 204/131 |
| 4,043,885 | 8/1977 | Yen et al. | 205/696 |
| 5,529,684 | 6/1996 | Greaney et al. | 205/688 |

OTHER PUBLICATIONS

Branthaver, J., "Influence of Metal Complexes in Fossil Fuels on Industrial Operations", Chapter 12, pp. 189–206, F.1by & Branthaver, eds., ACS, Washington, DC (1987). (no month).

*Primary Examiner*—Walter D. Griffin
*Attorney, Agent, or Firm*—Linda M. Scuorzo

[57] ABSTRACT

The invention is a method for demetallating petroleum streams by subjecting a hydrocarbon soluble metals-containing petroleum stream and an aqueous electrolysis medium to a sufficient anodic potential at a pH sufficient to produce a treated petroleum stream having a decreased metals content. The invention is useful for enhancing the value of petroleum streams that traditionally have limited use in refineries due to their content of metals, particularly Ni and V.

10 Claims, No Drawings

METHOD FOR ANODICALLY DEMETALLATING REFINERY FEEDSTREAMS

FIELD OF THE INVENTION

The present invention relates to a method for electrochemically demetallating refinery feedstreams.

BACKGROUND OF THE INVENTION

Petroleum streams that contain metals are typically problematic in refineries as streams because the metallic components contained therein have a negative impact on certain refinery operations. Thus, demetallation has been referred to as critical to help conversion of crude fractions (see e.g., Branthaver, Western Research Institute in Ch.12, "Influence of Metal Complexes in Fossil Fuels on Industrial Operations", Am. Chem. Soc. (1987)). Such metals, for example, act as poisons for hydroprocessing and fluid catalytic cracking catalysts, thereby, shortening the run length of such processes, increasing waste gas make and decreasing the value of coke product from coker operations.

The presence of such metals prevents more advantageous use of the petroleum stream by rendering especially the heaviest oil fractions (in which these metal containing structures most typically occur) less profitable to upgrade, and when these resources are used make catalyst replacement/disposal expensive and environmentally hazardous. Current refinery technologies typically address the problem by using metal containing feedstreams as a less preferred option, and by tolerating catalyst deactivation when there are not other feedstream alternatives available.

Electrochemical processes have been used for removal of water soluble metals from aqueous streams, see e.g., U.S. Pat. No. 3,457,152. Additionally, U.S. Pat. No. 5,529,684 discloses the electrochemical treatment of refinery streams, which occurs at specified cathodic potentials.

SUMMARY OF THE INVENTION

The present invention provides for a process for demetallating petroleum streams, comprising: passing an electric current through a hydrocarbon-soluble metals containing petroleum stream and an aqueous electrolysis medium at a sufficient anodic potential and at a pH sufficient to produce an oxidatively treated petroleum stream having a decreased metals content. The metals are typically Ni and V.

The present invention may suitably comprise, consist or consist essentially of the described elements and may be practiced in the absence of an element not disclosed.

DETAILED DESCRIPTION OF THE INVENTION

The present invention provides for a method for oxidatively decreasing the metals content of a petroleum fraction by subjecting a mixture or solution of a hydrocarbonaceous petroleum fraction or phase (also referred to herein as a stream or feed) containing the metals and an aqueous electrolysis medium to an anodic electric current for a time sufficient to remove the metals from the stream (i.e. to produce a petroleum fraction having decreased content of the metals typically, by producing a petroleum fraction having a decreased content of metals containing carbonaceous structures). The petroleum stream and aqueous electrolysis medium are contacted under conditions to result in passing of an anodic electric current therethrough. Thus, electrolytic oxidation at the anode of the electrolytic cell yields petroleum streams or fractions having a decreased metals content from the starting material.

The metallic species that may be removed include Ni and V species, as these are typically present in petroleum streams and are not removed advantageously or cost-effectively by other demetallation treatments. Transition metals such as Ni and V are often found, for example, in porphyrin and porphyrin-like complexes or structures, and are abundant as organo-metallic structures or moieties in heavy petroleum fractions. In these feeds such metal species tend to be found in non-water soluble or extractible or water immiscible structures.

By contrast, water soluble metal salts typically are currently removed from petroleum streams using an electrostatic desalter process. This process entails applying an electric field to aid in separation into essentially water-containing and essentially petroleum-containing phases. The water soluble metal salts are thereby extracted and removed from the petroleum streams. By contrast to the present invention, high voltage is applied in the absence or essential absence of current flow and the metals that are removed are essentially not hydrocarbon soluble. In the present invention the demetallation that is carried out decreases the metals content of the organic, (i.e., essentially hydrocarbon) metals containing phase.

A benefit of the process of the present invention is in its use to electrochemically remove metals contained in typically non-water extractable, metal containing organic moieties such as hydrocarbon soluble metal containing moieties.

Examples of Ni and V metal-containing petroleum streams, phase or fractions, including distillates thereof, that may be treated according to the process of the present invention are metal containing carbonaceous and hydrocarbonaceous petroleum streams, of fossil fuels such as crude oils and bitumens, as well as processed streams (distillation resids) such as atmospheric vacuum resid, fluid catalytic cracker feeds, metal containing deasphalted oils and resins, processed resids and heavy oils (heavy crudes) as these typically have a high metals content.

The feed to be demetallized can have a range of vanadium and/or nickel content. The average vanadium in the feed is typically about 15 ppm to 2,000 ppm, preferably about 20 to 1,000 ppm, by weight, most preferably about 20 to 100 ppm. The average nickel content in the starting feed is typically about 2 to 500 ppm, preferably about 2 to 250 ppm by weight, most preferably about 2 to 100 ppm. For example, a Heavy Arab crude distillate having an initial cut point of 950° F. (510° C.) and a final cut point of 1160° F. (627° C.) may have a typical nickel content of 8 ppm and a vanadium content of 50 ppm by weight. However, any level of nickel and/or vanadium may be treated according to the present invention.

The metal containing petroleum fraction to be contacted with the aqueous electrolysis medium preferably should be in a liquid or fluid state at process conditions. This may be accomplished by heating the material or by treatment with a suitable solvent as needed. This assists in maintaining the mixture of the metal containing petroleum stream or fraction and aqueous electrolysis medium in a fluid form to allow passage of an anodic current. Current densities of $1mA/cm^2$ of anode surface area or greater area are suitable. Contacting is typically accomplished by intimate mixing of the metal containing petroleum stream and the aqueous electrolysis medium to form a mixture or oil-in-water dispersion, for example using a stirred batch reactor or turbulence promoters in flowing cells.

Preferably droplets should be of sufficient size to enable the metals containing components to achieve intimate contact with the aqueous electrolysis medium. Droplet size particles of about 0.1 micron to 1.0 mm, for example are suitable.

Desirably the process should be carried out for a time and at conditions within the ranges disclosed sufficient to achieve a decrease, preferably a maximum decrease, in content of the metals.

Reaction temperatures will vary with the particular petroleum stream due to its viscosity, and the type of electrolyte and its pH. However, temperatures may suitably range from about ambient to about 700° F. (371° C.), preferably from 100° F. (38° C.) to 200° F. (93° C.), and pressures of from 0 atm (0 kPa) to 210 atm (21,200 kPa), preferably 1 atm (101 kPa) to 3 atm (303 kPa). An increase in temperature may be used to facilitate removal of metal species. Within the process conditions disclosed a liquid or fluid phase or medium is maintained.

Following demetallation, the product petroleum stream (organic phase) contains a decreased level of Ni and/or V content. While the actual amount removed will vary according to the starting feed, on average, vanadium levels of not more than about 15 ppm by weight, preferably less than about 4 ppm and on average nickel levels of less than about 10 ppm, preferably less than about 2 ppm can be achieved. Desirably greater than 30 percent by weight of the total vanadium and nickel can thereby be removed.

The metal decreased product may be used in refining operations that are adversely affected by higher levels of metals, for example fluid catalytic cracking or hydroprocessing, or such a product can be blended with other streams of higher or lower metals content to obtain a desired level of metals removal.

The electrolyte in the aqueous electrolysis medium is desirably an electrolyte that dissolves or dissociates in water to produce electrically conducting ions at the required pH, but that does not undergo redox in the range of applied potentials used. Organic electrolytes include quaternary carbyl and hydrocarbyl onium salts, e.g., and alkyl ammonium hydroxides and tetrabutyl ammonium toluene sulfate and organic acids. Inorganic electrolytes include acids and under appropriate conditions bases NaOH, KOH and other inorganic salts. Mixtures thereof also may be used. Suitable onium ions include mono- and bis-phosphonium, sulfonium and ammonium, preferably ammonium ions. Carbyl and hydrocarbyl moieties are preferably alkyl. Quaternary alkyl ammonium ions include tetrabutyl ammonium, and tetrabutyl ammonium toluene sulfonate. Optionally, additives known in the art to enhance performance of the electrodes or the system may be added such as surfactants, detergents, emulsifying agents and depolarizing agents. The concentration of electrolyte in the electrolysis medium should be sufficient to generate an electrically conducting solution in the presence of the petroleum component. Typically a concentration of 1–50 wt % electrolyte in the aqueous phase, preferably 5–25 wt %, is suitable.

Within the process conditions disclosed, the pH of the aqueous electrolysis medium can be varied. However, the pH should be sufficient to maintain an anodic voltage within the disclosed range. The demetallation can be carried out in any suitable pH within that range, preferably at an acidic pH (pH less than 7).

It is possible to carry out the process in air or under an inert atmosphere. A benefit to the present invention is that the process may be operated under ambient temperature and atmospheric pressure, although higher temperature and pressures also may be used as needed.

The process is carried out in an electrochemical cell, by electrolytic means, i.e. in a non-electrostatic, mode, as passage of current through the mixture or oil-inwater dispersion is required (e.g., relatively low voltage/high current). The cell may be either divided or undivided. Such systems include stirred batch or flow through reactors. The foregoing may be purchased commercially or made using technology known in the art.

Electrodes that facilitate anodic oxidation, i.e., having high oxygen overpotential are suitable as anodes for oxidative removal of metals such as Ni or V, e.g., platinum, lead and carbon. Included as suitable electrodes are three-dimensional electrodes, such as carbon or metallic foams. The anodic voltage will vary within the disclosed range depending on the metal to be removed.

The anodic voltage should be in a range +0.5 to +1.5 V Saturated Calomel Electrode (SCE), based on the characteristics of the particular petroleum fraction. While direct current is typically used, electrode performance may be enhanced using alternating current, or other voltage/current waveforms.

What is claimed is:

1. A process for demetallating petroleum streams, comprising: passing an electric current through a hydrocarbon-soluble metals-containing petroleum stream and an aqueous electrolysis medium at a sufficient anodic potential and at a pH sufficient to oxidatively demetallate the petroleum stream.

2. The process of claim 1 wherein the metals are selected from the group consisting of nickel and vanadium.

3. The process of claim 1 wherein the anodic potential is from about +0.5 to +1.5 V vs. SCE.

4. The process of claim 1 wherein the petroleum stream is selected from the group consisting of crude oils, catalytic cracker feeds, bitumen, and distillation resids.

5. The process of claim 1 wherein the aqueous electrolysis medium contains salts selected from the group consisting of inorganic salts, organic salts, inorganic acids, organic acids and mixtures thereof.

6. The process of claim 1 wherein the aqueous electrolysis medium has a pH less than 7.

7. The process of claim 1 wherein the temperature is up to 700° F. (371° C.).

8. The process of claim 1 wherein the pressure is from about 0 atm (0 kPa) to about 210 atm (21,200 kPa).

9. The process of claim 1 wherein the concentration of the electrolyte in the aqueous electrolysis medium is 1 to 50 wt %.

10. The process of claim 1 wherein the metals containing petroleum stream and aqueous electrolysis medium form an oil in water dispersion.

* * * * *